US007004409B2

(12) United States Patent
Okubo

(10) Patent No.: US 7,004,409 B2
(45) Date of Patent: Feb. 28, 2006

(54) WATER SPRAY PLATE AND SHOWER HEAD

(76) Inventor: Takayasu Okubo, 3-1-907, Sumiregaoka 2-chome, Takarazuka-shi, Hyogo 665-0847 (JP)

( * ) Notice: Subject to any disclaimer, the term of this patent is extended or adjusted under 35 U.S.C. 154(b) by 0 days.

(21) Appl. No.: 10/871,034

(22) Filed: Jun. 21, 2004

(65) Prior Publication Data

US 2004/0227019 A1 Nov. 18, 2004

Related U.S. Application Data

(63) Continuation of application No. PCT/JP03/01807, filed on Feb. 19, 2003.

(30) Foreign Application Priority Data

Feb. 22, 2002 (JP) ..... 2002-093253
Feb. 26, 2002 (JP) ..... 2002-099369

(51) Int. Cl.
*B05B 1/14* (2006.01)
*B05B 9/08* (2006.01)

(52) U.S. Cl. ..... 239/559; 239/556; 239/558; 239/530

(58) Field of Classification Search ..... 239/559, 239/556, 558, 530, 548, 552, 553.3, 557, 239/560, 561, 567, 525, 590.3, 596, 601
See application file for complete search history.

(56) References Cited

U.S. PATENT DOCUMENTS 1,895,307 A * 1/1933 Beck ..... 239/499
2,860,920 A * 11/1958 Waller ..... 239/558
3,037,710 A * 6/1962 Kusznier ..... 239/526
4,056,229 A * 11/1977 Jones ..... 239/288
6,185,756 B1 * 2/2001 Roesler et al. ..... 4/515
6,776,357 B1 * 8/2004 Naito ..... 239/533.14

FOREIGN PATENT DOCUMENTS

| | | | |
|---|---|---|---|
| JP | 06-173039 | | 6/1994 |
| JP | 3009592 | | 1/1995 |
| JP | 8-266940 | | 10/1996 |
| JP | 11-000583 | | 1/1999 |
| JP | 11-300234 | | 11/1999 |
| JP | 2000-37641 | | 2/2000 |
| JP | WO00/22972 | * | 4/2000 |

* cited by examiner

*Primary Examiner*—David A. Scherbel
*Assistant Examiner*—Darren Gorman
(74) *Attorney, Agent, or Firm*—Duckstein, Shapiro, Morin & Oshinsky, LLP.

(57) ABSTRACT

A number of water spray holes formed on a water spray plate is not less than 130. A diameter of the respective water spray holes is not less than 0.1 mm and not more than 0.5 mm, and an entire aperture area thereof is not more than 30 $mm^2$. With this arrangement, since the entire aperture area of the water spray holes is reduced, it is possible to achieve water-saving effects. Moreover, since the water spray holes are small and provided by a plurality of numbers, the flow of water sprayed from the respective water spray holes is large to feel some strength hitting the skin and to achieve expansion of shower water so that the sense of using the shower may be satisfied. Moreover, since a plurality of small water spray holes is formed, a larger number of minus ion can be generated.

11 Claims, 3 Drawing Sheets

WATER SPRAY PLATE AND SHOWER HEAD

CROSS-REFERENCE TO RELATED APPLICATIONS

This is a Continuation application of PCT Application No. PCT/JP03/01807, filed Feb. 19, 2003, which was not published under PCT Article 21(2) in English.

This application is based upon and claims the benefit of priority from prior Japanese Patent Applications No. 2002-093253, filed Feb. 22, 2002; and No. 2002-099369, filed Feb. 26, 2002, the entire contents of both of which are incorporated herein by reference.

BACKGROUND OF THE INVENTION

1. Field of the Invention

The present invention relates to a structure of a water spray plate for spraying shower water that is mounted to particularly a tip end of a shower head as one used in shower rooms, bathrooms, wash sinks or in barbershops and beauty salons.

2. Description of the Related Art

A shower head is generally arranged in that a water spray plate is mounted to a tip end of a main body of the shower head that is connected to a shower hose. A plurality of small water spray holes of identical size opens on the water spray plate. Water or hot water supplied through the shower hose passes through a main body of the shower hose and is split through the plurality of water spray holes formed on the water spray plate. Through these water spray holes, small streams of water, that is, shower water, is respectively discharged.

A generally used conventional shower head was arranged to have a diameter of the water spray holes of the water spray plate of approximately 0.8 mm to 1.0 mm, to have a number of holes of approximately 60 to 100, and to have an entire aperture area of approximately 40 $mm^2$ to 65 $mm^2$.

Shower heads referred to as water-saving type shower heads are being sold in these days. More particularly, various measures are taken for saving the amount of water when using the shower. For instance, Japanese Unexamined Patent Publication No. 8-266940 (1996) suggests a shower head provided with a water flow portion of narrow diameter having a shape in which its outlet side is widened in diameter in the interior of a head portion. However, special parts are required for forming the water flow portion of narrow diameter in this prior art example so that inconveniences such as increases in manufacturing costs are caused.

Theoretically, the entire aperture area of the water spray holes shall be generally made small for reducing the amount of water when using the shower. For this purpose, the number of water spray holes or the diameter of the respective water spray holes shall be reduced.

However, while it is possible to achieve water-saving effects by merely reducing the number of water spray holes, dispersed expansion as shower water cannot be obtained. Inconveniences are accordingly caused in that the sense of showering is lost or that the amount of water that hits a portion to be washed is reduced. Since the washing action is degraded in this manner, the time of using the shower is prolonged so that the initial purpose of saving water cannot be achieved. Moreover, while water-saving effects can be exhibited by merely reducing the size of the respective water spray holes, drawbacks are presented in that the spraying pressure will become higher so that one might feel pain when water hits his or her body.

Plus ion and minus ion are present in air in a balanced manner. In urban areas in which the air is polluted, the amount of plus ion in air tends to be increased while reductions in minus ions are observed. In natural world, a large amount of minus ion is observed in air when being in woodlands or hot-spring areas and when close to waterfalls and fountains. In such circumstances in which the amount of minus ion in air is large, it is said that there is beneficial effect on work efficiency, amenity, weariness and healing of human beings.

Minus ion is generated by large amounts when close to waterfalls, wherein minus ion is generated when dropping water is crushed. It is said that the amount of minus ion within air is accordingly increased in its periphery and this is also known to be a Lenard effect. Such a Lenard effect can be similarly obtained through shower water and minus ion was generated also when using conventional shower heads.

However, the inventors of the present invention have found out that the amount of generated minus ion when using conventional shower heads was not so large.

BRIEF SUMMARY OF THE INVENTION

It is a first object of the present invention to provide a water spray plate with which it is possible to obtain water-saving effects and a shower head employing the same.

It is a second object of the present invention to provide a water spray plate with which it is possible to generated minus ion by a large amount and a shower head employing the same.

In the present invention, a water spray plate is provided in which the number of water spray holes is not less than 130, in which a diameter of the respective water spray holes not less than 0.1 mm and not more than 0.5 mm, and in which an entire aperture area of the water spray holes is not more than 30 $mm^2$.

Since such a water spray plate is arranged in that the entire aperture area of the water spray holes is not more than 30 $mm^2$, the aperture area is smaller when compared to prior art examples and the amount of flowing water is reduced so that it is possible to achieve water-saving effects. Moreover, since the number of water spray holes is not less than 130 and the diameter of the respective water spray holes is not less than 0.1 mm and not more than 0.5 mm, the number of holes is larger and the water spray holes smaller when compared to prior art examples. Accordingly, a large amount of narrow water will be sprayed from the respective water spray holes at a large flow rate so that it is possible to achieve high cleaning effects and the sense of using the shower can be satisfied.

Since the number of water spray holes of the water spray plate of the present invention is large, the number of spraying of the shower will become larger so that the number of striking water is increased. Accordingly, water is crushed so that small particles may be easier generated by a large amount so that the amount of generated minus ion is consequently increased. Preferably, the number of water spray holes is not less than 150 and not more than 350.

When the diameter of the water spray holes is set to be not less than 0.1 mm and not more than 0.5 mm, sprayed water discharged from the respective holes will become narrow. When such sprayed water is struck, water may be even easier crushed so that the amount of generated minus ion is also increased.

In this regard, the size of the water spray holes is desirably not less than 0.2 mm and not more 0.4 mm in view of relation with the plate thickness of the water spray plate.

According to a preferred embodiment of the present invention, there is provided a water spray plate in which a plurality of first water spray holes is provided in a central portion in a concentrated manner and in which a plurality of second water spray holes is annularly arranged in the periphery thereof.

With such a water spray plate, a large amount of water is sprayed from the plurality of first water spray holes formed in the central portion in a concentrated manner. It is accordingly possible to supply a large amount of water to a portion to be washed and to obtain high cleaning effects. The second water spray holes disposed annularly at positions located closer to the outer periphery of the water spray plate jet water to outer peripheral portions of the region of water that is jetted to the portion to be washed. By simultaneously spraying water through the first water spray holes and the second water spray holes, expansion of shower water may be achieved so as to expand the area of washing, to satisfy the sense of using the shower, and further to improve the external appearance of the shower water.

According to another preferred embodiment, the second water spray holes are arranged concentrically as a plurality of lines. Accordingly, the way of the water expands may be made uniform.

According to still another embodiment, the second water spray holes are arranged to be larger in diameter than that of the first water spray holes that are concentrated in the center. With this arrangement, the amount of water hitting the central portion and the amount of water hitting the peripheral portion can be well balanced.

According to still another embodiment, a surface of the water spray plate on which the second water spray holes are formed is bent or inclined such that shower water expands outward. With this arrangement, the diffusiveness of shower water sprayed from the second water spray holes can be improved.

According to another embodiment, the water spray plate is formed of a metallic thin plate on which the water spray holes are formed through photo-etching. With this arrangement, it is possible to easily manufacture a water spray plate formed with a plurality of small water spray holes.

According to the present invention, there is provided a shower head in which the above water spray plate is mounted to a main body of the shower head. The shower head comprises the advantages exhibited by the water spray plate.

In a preferred embodiment of such an example, a spraying speed of sprayed water discharged through the water spray holes is not less than 20 km/h where the amount of conducted water is 10 liter per minute. In case of such a spraying speed, the striking energy of sprayed water will become large. Accordingly, the water can be easily crushed minutely at the time of striking whereby small particles of water are generated by a large amount, and the amount of generated minus ion is accordingly increased.

According to the present invention, since a plurality of water spray holes of small diameter is formed on the water spray plate and the entire aperture area of the water spray holes is reduced, it is possible to exhibit water-saving effects. By further forming a plurality of small water spray holes, sprayed water may be easily crushed when struck and the amount of generated minus ion is increased.

When the first water spray holes are formed in the central portion of the water spray plate in a concentrated manner, a large amount of water will be sprayed from the central portion of the water spray plate in a concentrated manner so that a large amount of water may be supplied to a portion to be washed to thereby exhibit high washing effects. When second water spray holes are annularly disposed in the periphery of the first water spray holes, water will also be discharged to an outer peripheral region of water that is jetted out from the first water spray holes. With this arrangement, it is possible to achieve expansion of shower water so as to satisfy the sense of using the shower.

DETAILED DESCRIPTION OF THE INVENTION

Figure 1:
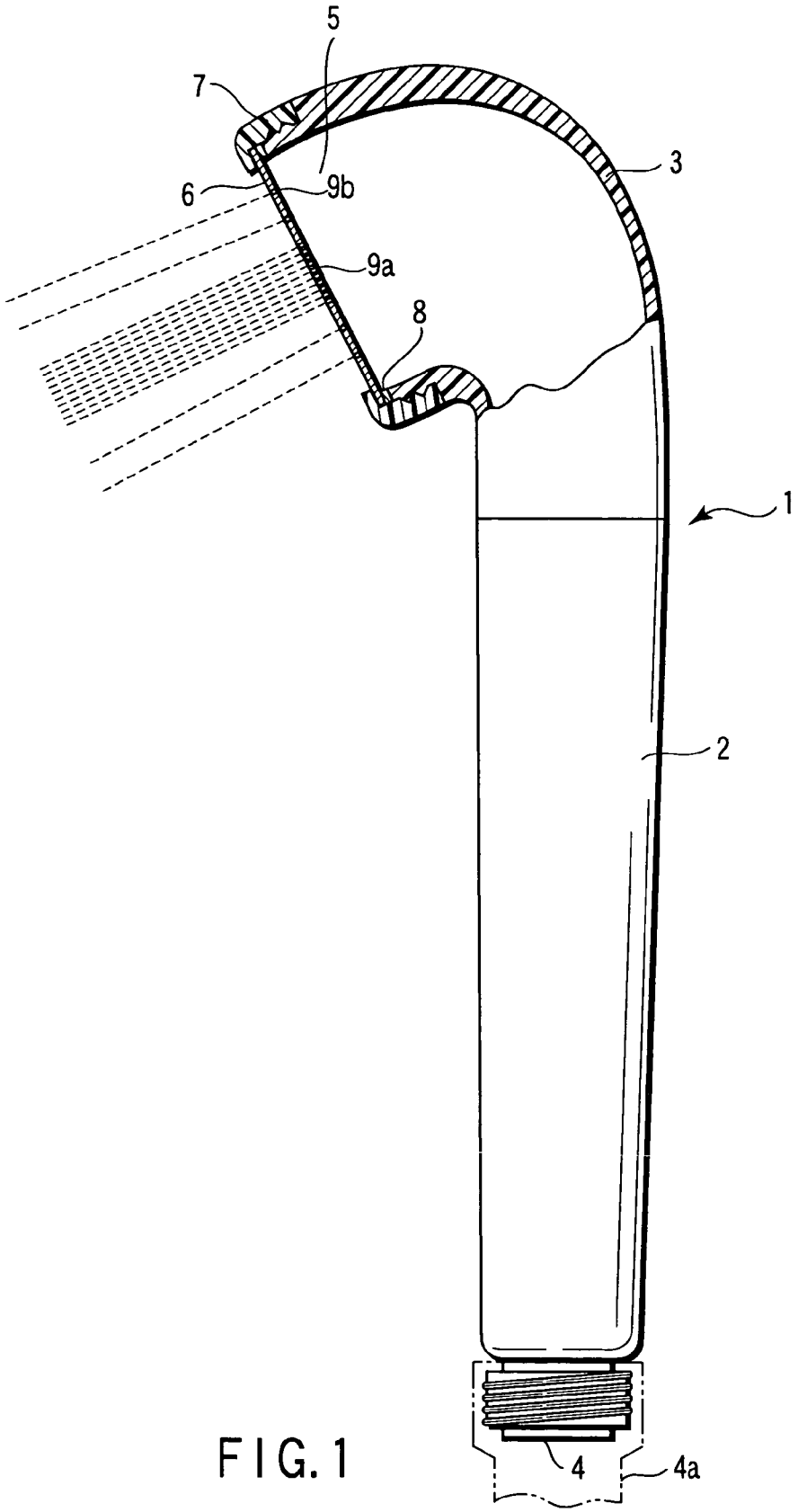
FIG. 1 is a side view illustrating a shower head representing a first embodiment of the present invention in a partially sectional manner.
Figure 2:
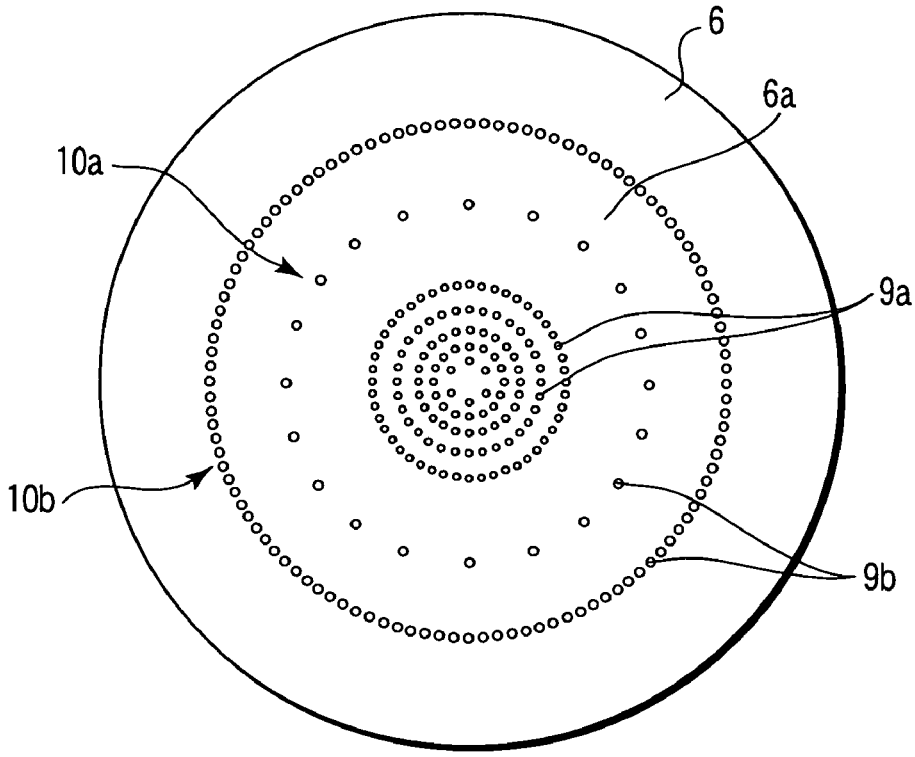
FIG. 2 is a front view of a water spray plate illustrating an arrangement pattern of water spray holes of the shower head as illustrated in FIG. 1.
Figure 3:
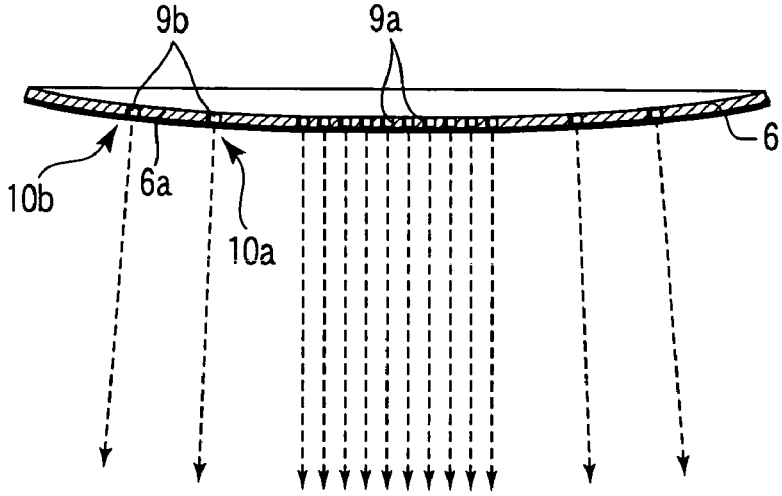
FIG. 3 is a sectional view of the water spray plate of the shower head as illustrated in FIG. 1.

One embodiment will now be explained with reference to FIGS. 1 to 3 in which the present invention is applied to a shower head. FIG. 1 is a side view illustrating a part of a shower head in a sectional manner, FIG. 2 is a front view of a water spray plate, and FIG. 3 is a sectional view of the water spray plate.

A main body of the shower head 1 as illustrated in FIG. 1 comprises a grip portion 2 and a head portion 3. The grip portion 2 and the head portion 3 are made of synthetic resin, and are connected together through means such as screw joint or bayonet joint (not shown) in a freely attachable/detachable manner.

The grip portion 2 is of hollow cylindrical shape and includes a feed port 4 at one end thereof. The feed port 4 is connected to a shower hose 4*a* (only a part thereof is illustrated). The shower hose 4*a* is connected, as conventionally known, to a hydrant cock or a mixing cock or similar.

The head portion 3 is connected to the other end of the grip 2. The head portion 3 includes a substantially L-shaped hollow space wherein its one end is connected to an interior space of the grip portion 2 while a discharge outlet 5 opens at the other end thereof. A water spray plate 6 is mounted to the discharge outlet 5. The water spray plate 6 is mounted to the head portion 3 in a freely attachable/detachable manner through a clamp ring 7 and is maintained in a watertight manner through a seal member 8 such as rubber.

The water spray plate 6 will now be explained.

The water spray plate 6 according to the present embodiment is made of a thin plate of stainless steel. The stainless steel thin plate is disk-like, having a plate thickness of approximately 0.4 mm and a diameter of approximately 50 mm. A plurality of water spray holes 9*a*, 9*b* are formed on such a stainless steel water spray plate 6. The diameter of the respective water spray holes is not less than 0.1 mm and not more than 0.5 mm. According to this embodiment, there are formed two types of water spray holes 9*a*, 9*b* of a diameter of 0.32 mm and of a diameter of 0.37 mm, as will be described later.

The water spray holes 9*a*, 9*b* are arranged as illustrated in FIG. 2. More particularly, a plurality of first water spray holes 9*a* is formed in a central portion of the water spray plate 6 in a concentrated manner. The diameter of the water spray holes 9*a* of the central portion is 0.32 mm. Total 80 to 150 of such water spray holes 9*a* open within a circle having a diameter of approximately 15 mm in the central portion of the water spray plate 6. More concretely, total 144 of water spray holes 9*a* open while creating 5 water spray hole rows. The entire aperture area of the first water spray holes 9*a* is 11.57 $mm^2$.

A plurality of second water spray holes 9*b* are annularly disposed around the first water spray holes 9*a*. The diameter of the water spray holes 9*b* is 0.37 mm. In the present embodiment, the second water spray holes 9*b* are arranged on two concentric rows as water spray hole rows 10*a*, 10*b*. The inner water spray hole row 10*a* is provided with total 18 water spray holes 9*b* on a circumference of a diameter of 30 mm. The outer water spray hole row 10*b* is provided with total 72 water spray holes 9*b* on a circumference of a diameter of 35 mm. Accordingly, the number of water spray holes 10*a*, 10*b* is total 90. The entire aperture area of the second water spray holes 9*b* is 9.67 $mm^2$. The entire aperture area of the water spray holes 9*a*, 9*b* of the entire water spray plate is 21.24 $mm^2$.

As illustrated in FIG. 3, the water spray plate 6 is arranged in that its central portion forms a flat surface while the periphery thereof includes a bent surface 6*a*, and it is as a whole formed in a dish-shaped manner that bulges forward. The first water spray holes 9*a* are provided on the flat surface at the central portion of the water spray plate 6. The second water spray holes 9*b* (water spray hole rows 10*a*, 10*b*) are formed at the bent surface 6*a* at the periphery of the water spray plate 6.

Since such a water spray plate 6 is arranged in that the respective water spray holes 9*a*, 9*b* are small holes and in that they are partially disposed at high density, drawbacks are presented in that hole forming through drilling or similar require a good deal of trouble. Moreover, when employing die forming through resin, the molds will be of complicated shape and the life of the molds will become shorter as well. For such reasons, the water spray plate 6 of the present embodiment is manufactured of a stainless steel thin plate that undergoes photo-etching.

Actions of the shower head of the above arrangement will now be explained.

The main body of the shower head 1 is connected to the shower hose 4*a*. When the hydrant cock is opened, tap water (or hot water) is supplied to the main body of the shower head 1 through the shower hose 4*a*. The water runs from the feed port 4 at the lower end of the grip portion 2 through the grip portion 2 to reach the head portion 3, and it is simultaneously sprayed through the first water spray holes 9*a* and the second water spray holes 9*b* of the water spray plate 6 formed at the discharge outlet 5 as shower water.

The water spray plate 6 of the present embodiment is arranged in that total 144 of the first water spray holes 9*a* having a diameter of 0.32 mm are formed and in that total 90 of the second water spray holes 9*b* having a diameter of 0.37 mm are formed. Accordingly, the entire aperture area of the water spray holes 9*a*, 9*b* is 21.24 $mm^2$. As it will be described later in details, the water spray plate 6 of the present embodiment exhibits higher water-saving effects when compared to conventional shower heads, and it is possible to reduce the amount of conducted water per unit time.

In addition thereto, since the water spray plate 6 is provided with total 144 of the first water spray holes 9*a* having a diameter of 0.32 mm that are concentrated at the central portion thereof, water is sprayed from the central portion of the water spray plate 6 in a concentrated manner as illustrated by the broken line. Accordingly, since a large amount of water is sprayed from the central portion of the water spray plate 6, this will form a water jet so that a large amount of water is supplied to a portion to be washed. It is accordingly possible to obtain sufficient cleaning effects.

On the other hand, shower water is sprayed from the periphery of the central portion of the water spray plate 6 through the sprinkling water rows 10*a*, 10*b* of the second water spray holes 9*b* disposed annularly. Accordingly, water is discharged towards the outer peripheral portion of the region of water hitting the central portion of a portion to be washed, and this will lead to the expansion of the shower water. Since shower water is discharged also to the peripheral portion of a portion to be washed, the sense of using the shower is improved and the external appearance of shower water is also improved.

In the present embodiment, the water spray hole rows 10*a*, 10*b* arranged in an annular manner is arranged in that total 90 of the water spray holes 9*b* having a diameter of 0.37 mm are formed and in that the water spray holes 9*b* are formed in a diversified manner of two rows. Accordingly, the distribution of shower water sprayed to the periphery will be uniform and it will also be possible to secure some amount of water for the periphery and to obtain a favorable external appearance of the shower.

While the number of second water spray holes 9*b* comprised as the annularly arranged water spray hole rows 10*a*, 10*b* is smaller than that of the first water spray holes 9*a* provided in the center in a concentrated style, the second water spray holes 9*b* are of a diameter that is larger than that of the first water spray holes 9*a*. With this arrangement, the amount of jet stream hitting at the central portion in a concentrated manner and the amount of shower water hitting its periphery will be well balanced. Supposing that the amount of water of the central jet stream is large, one might feel that he or she is only submitted to the jet stream and the sense of taking a shower will become weak. On the other hand, when the amount of shower water in the periphery becomes large, a sense of pressure of totally being submitted to water will become weak so that one might feel somewhat disappointed.

Since the water spray plate 6 of the present embodiment is arranged in that the surface formed with the water spray hole rows 10*a*, 10*b* of the second water spray holes 9*b* forms a bent surface 6*a*, shower water will be expanded to the exterior so that the diffusiveness of shower water is further improved.

The present invention is effective when applied to a so-called water-saving type water spray plate having a total number of water spray holes 9*a*, 9*b* of not less than 130, having a diameter of the respective water spray holes 9*a*, 9*b* of not less than 0.1 mm and not more than 0.5 mm, and having an entire aperture area of the water spray holes 9*a*, 9*b* of not more than 30 $mm^2$. The water-saving effects will be explained.

Water-saving effects have been evaluated in Table 1 wherein the maximum flow rates of the respective shower heads have been measured at constant valve travel of the hydrant cocks to which shower hoses are connected. The pressure of tap water (pressure at end of tap when the hydrant cock is closed) at this time was 0.26 Mpa (hydrostatic pressure).

TABLE 1

| Type of shower | Number of holes | Hole diameter (mm) | Entire aperture area ($mm^2$) | Maximum flow rate (liter/minute) |
|---|---|---|---|---|
| Comparative Example 1 (manufactured by company A) | 84 | 1.0 | 65.94 | 17.2 |
| Comparative Example 2 (manufactured by company B) | 104 | 0.8 | 52.25 | 17.1 |
| Comparative Example 3 (manufactured by company C) | 60 | 1.0 | 47.1 | 16.7 |
| Comparative Example 4 (manufactured by company D) | 84 | 0.8 | 42.2 | 15.5 |
| Comparative Example 5 (manufactured by company E) | 62 | 0.8 | 31.15 | 14.2 |
| Embodiment 1 | 234 | 0.32 ϕ 144 pieces<br>0.37 ϕ 90 pieces | 21.24 | 12 |
| Embodiment 2 | 226 | 0.32 ϕ 144 pieces<br>0.45 ϕ 82 pieces | 24.60 | 12.2 |
| Embodiment 3 | 252 | 0.32 ϕ 144 pieces<br>0.45 ϕ 108 pieces | 28.74 | 12.7 |
| Embodiment 4 | 153 | 0.4 | 19.21 | 11.8 |
| Embodiment 5 | 225 | 0.32 | 18.09 | 11.3 |
| Embodiment 6 | 132 | 0.4 | 16.57 | 1.9 |

Measured results in which the number of holes, the diameter of holes, the entire aperture area and the maximum flow rate have been measured regarding the various shower heads are illustrated in Table 1. As the Comparative Examples 1 to 5 in Table 1, existing shower heads were measured. As the Embodiments 1 to 6, measured values of various shower heads corresponding to the present invention are listed.

As it can be understood from Table 1, the smaller the entire aperture area of the water spray holes is, the smaller the maximum flow rate will be so as to exhibit water-saving effects. In the Comparative Examples 1 to 5, while the number of water spray holes is small, the diameter of the respective holes is large and the entire aperture area exceeds 30 $mm^2$. The maximum flow rate will accordingly be large and the water-saving effects low.

In contrast thereto, since the entire aperture area is not more than 30 $mm^2$ in the Embodiments 1 to 6, the maximum flow rate will be small to thereby exhibit water-saving effects.

The present Embodiment 1 exhibits water-saving effects of 69% when compared to the conventional Comparative Example 1.

On the other hand, the shower head of the present Embodiment 1 is arranged in that the number of water spray holes 9*a*, 9*b* formed on the water spray plate 6 is total 234, and thus, the number of holes is remarkably larger than that of conventional shower heads. The number of sprayed streams sprayed from the water spray plate will accordingly be increased and when water hits the skin or the head portion of a human body, chances that particles of water hit with each other will be increased. Droplets and particles of water will thus be minutely crushed in an easier manner and minute particles of water will be generated by a large amount.

The Lenard effect may be achieved through generation of minus ion when droplets crush. Accordingly, when minute particles of water are generated by a large amount through striking of water, the amount of minus ion in air will consequently be increased.

In addition thereto, the above embodiment is arranged in that not only the number of water spray holes 9*a*, 9*b* is large but also the sizes of the holes are smaller than those of the prior art with the diameters being 0.32 mm and 0.37 mm. Due to this fact, water sprayed from the respective water spray holes 9*a*, 9*b* will be narrow streams. Therefore, when water hits the skin or the head portion of a human body, more minute particles of water may be generated by a large amount through the narrow streams of water. Therefore, it is possible to exhibit the Lenard effect and to generate a large amount of minus ion.

Moreover, the shower head of Embodiment 1 is arranged in that the entire aperture area of the water spray holes 9*a*, 9*b* opening on the water spray plate 6 is 21.24 $mm^2$ and is thus smaller than those of conventional shower heads. The spraying speed of water sprayed through the water spray holes 9*a*, 9*b* will accordingly be larger when compared to those of conventional shower heads. The striking speed when sprayed water hits the skin or the head portion of a human body will thus be larger, and water will be minutely crushed through the large striking energy. Since the striking energy is large, droplets hitting the striking surface will be crushed and more easily spread, and the rate of spread droplets repeatedly striking other droplets will also be increased.

Such a large spraying speed will further enhance the Lenard effects and a large amount of minus ion generated through droplets and water particles hitting with each other will be generated.

Results of measuring the amount of generated minus ion will now be explained on the basis of Table 2.

The amounts of minus ion illustrated in Table 2 are values obtained when various shower heads were connected to a shower hose and the amounts of minus ion generated through shower water sprayed from the shower heads and striking against a plate disposed to be 40 cm apart from the shower heads were measured by using a minus ion measuring device. The measuring device was a minus ion measuring device of type CI-1000 capable of measuring the amount of generated minus ion per $cm^3$.

TABLE 2

| Type of shower | Number of holes | Hole diameter (mm) | Entire aperture area ($mm^2$) | Flow rate (liter/minute) | Spraying speed (km/h) | Amount of minus ion (piece/$cm^3$) |
|---|---|---|---|---|---|---|
| Comparative Example 1 (manufactured by company A) | 84 | 1.0 | 65.94 | 7.0 | 6.37 | 2,000 |
| | | | | 10.0 | 9.10 | 3,000 |
| | | | | 13.0 | 11.83 | 20,000 |
| Comparative Example 2 (manufactured by company B) | 104 | 0.8 | 52.25 | 7.0 | 8.04 | 3,000 |
| | | | | 10.0 | 11.48 | 35,000 |
| | | | | 13.0 | 14.93 | 50,000 |
| Comparative Example 3 (manufactured by company C) | 60 | 1.0 | 47.10 | 7.0 | 8.92 | 16,000 |
| | | | | 10.0 | 12.74 | 20,000 |
| | | | | 13.0 | 16.56 | 50,000 |
| Comparative Example 4 (manufactured by company D) | 84 | 0.8 | 42.20 | 7.0 | 9.95 | 13,000 |
| | | | | 10.0 | 14.22 | 45,000 |
| | | | | 13.0 | 18.48 | 65,000 |
| Comparative Example 5 (manufactured by company E) | 62 | 0.8 | 31.15 | 7.0 | 13.48 | 45,000 |
| | | | | 10.0 | 19.26 | 70,000 |
| | | | | 13.0 | 25.04 | 80,000 |
| Embodiment 1 | 234 | 0.32φ 144 pieces | 21.24 | 7.0 | 19.44 | 125,000 |
| | | 0.37φ 90 pieces | | 10.0 | 27.78 | 230,000 |
| | | | | 13.0 | 36.72 | 310,000 |
| Embodiment 2 | 226 | 0.32φ 144 pieces | 24.60 | 7.0 | 17.07 | 100,000 |
| | | 0.45φ 82 pieces | | 10.0 | 24.39 | 200,000 |
| | | | | 13.0 | 31.70 | 300,000 |
| Embodiment 3 | 252 | 0.32φ 144 pieces | 28.74 | 7.0 | 14.61 | 100,000 |
| | | 0.45φ 108 pieces | | 10.0 | 20.87 | 160,000 |
| | | | | 13.0 | 27.13 | 220,000 |
| Embodiment 4 | 153 | 0.4 | 19.21 | 7.0 | 21.86 | 150,000 |
| | | | | 10.0 | 31.23 | 210,000 |
| | | | | 13.0 | 40.60 | 270,000 |
| Embodiment 5 | 225 | 0.32 | 18.09 | 7.0 | 23.22 | 125,000 |
| | | | | 10.0 | 33.17 | 230,000 |
| | | | | 13.0 | 43.12 | 310,000 |
| Embodiment 6 | 132 | 0.4 | 16.57 | 7.0 | 25.35 | 150,000 |
| | | | | 10.0 | 36.21 | 230,000 |
| | | | | 13.0 | 47.07 | 330,000 |

As the Comparative Examples 1 to 5 in Table 2, measured values of existing shower heads were employed.

Such conventional shower heads included a small number of water spray holes while the size of the holes was not less than 0.8 mm, and the entire aperture area is large as a whole. When the amount of generated minus ion was counted for the conventional shower heads, the maximum amount of generated minus ion was not more than 80,000 pieces/$cm^3$ also at a maximum flow rate of 13 liters/minute.

In contrast thereto, according to the present Embodiment 1, the amount of generated minus ion was not less than 125,000 pieces/$cm^3$ also at a flow rate of 7 liters/minute, and an amount of generated minus ion of even 310,000 pieces/$cm^3$ was counted when the flow rate was 13 liters/minute, and it was accordingly confirmed that the amount of generated minus ions was remarkably large.

In the Embodiments 2 to 6, the amounts of generated minus ion were respective measured upon changing the numbers and sizes of water spray holes, wherein the number of water spray holes was not less than 130 and the diameter of the holes 0.32 mm to 0.45 mm. Also in the Embodiments 2 to 6, the amounts of generated minus ion respectively exceeded 100,000 pieces/$cm^3$ and it was confirmed that a large amount of minus ion could be generated.

Figure 4:
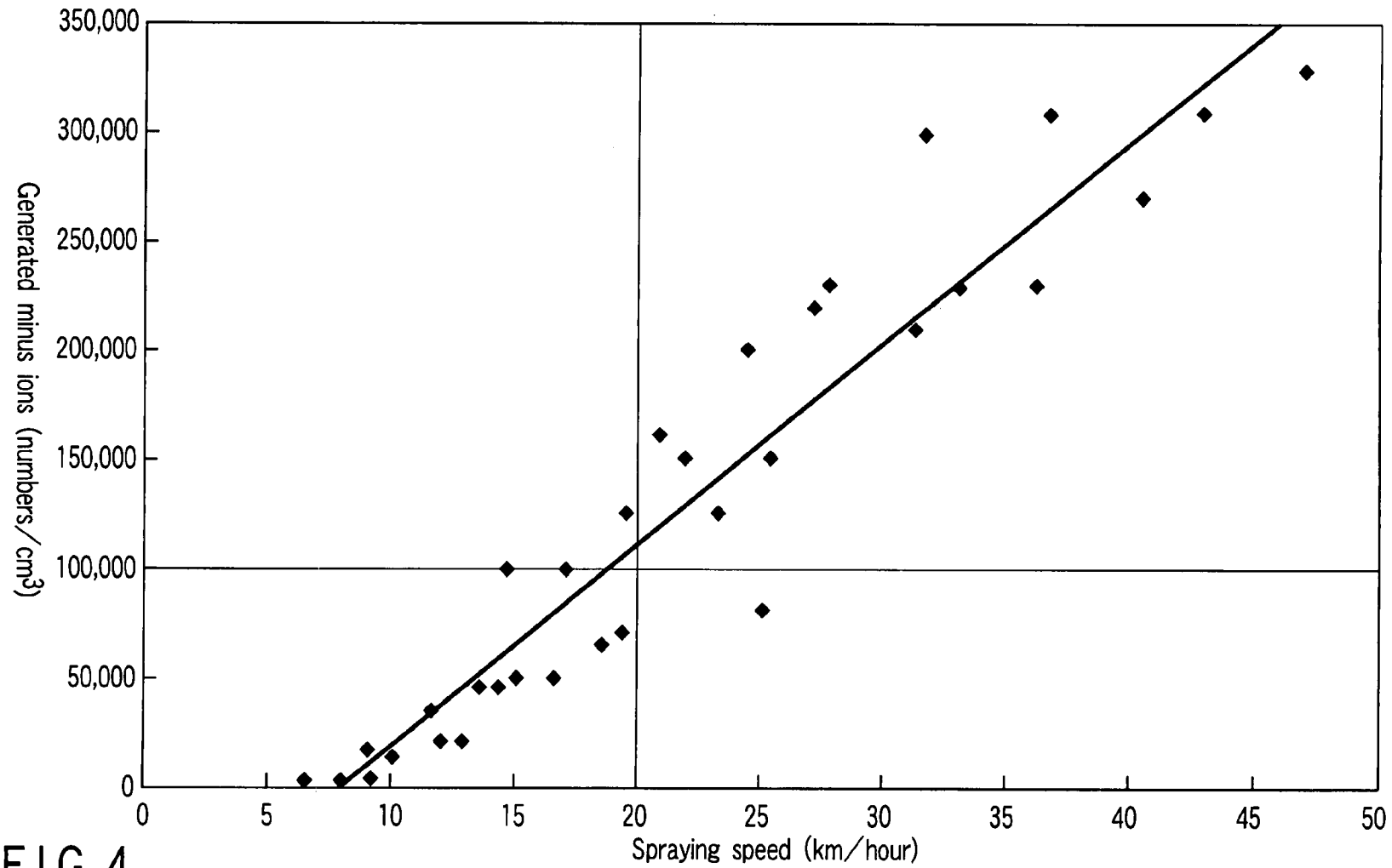
FIG. 4 is a graph showing the relationship between spraying speed and amount of generated minus ion.

The relationship between the spraying speed and the amount of minus ion of Table 2 is illustrated in FIG. 4. As it can be understood from the approximation line of FIG. 4, when the total number of water spray holes is not less than 130, the diameter of the respective water spray holes not less than 0.1 mm and not more than 0.5 mm, the entire aperture area of the water spray holes not more than 30 $mm^3$ and the spraying speed not less than 20 km/h when the flow rate is 10 liters/minute, the amount of generated minus ion will exceed 100,000 pieces/$cm^3$. Based on this fact, the spraying speed is desirably not less than 20 km/h when the flow rate is 10 liters/minute.

In this regard, the smaller the entire aperture area of the water spray holes is, the stronger the momentum of sprayed water will be, while when the momentum becomes too strong, one might feel pain when water hits his or her skin. Accordingly, the entire aperture area of the water spray holes is desirably not more than 30 $mm^2$ and not less than 15 $mm^2$.

The above water spray plate 6 of the present Embodiment 1 is formed of a stainless steel plate and is manufactured through photo-etching. Accordingly, a plurality of first water spray holes 9*a* may be easily disposed at high density at the central portion. Supposing that one tries to form water spray holes of the same density by using synthetic resin, it will be necessary to accurately form small needle-like projections at the forming molds. Such molds are difficult to be manufactured and also exhibit problems that the needle-like projections are easily broken, and manufacture through photo-etching is thus advantaged.

In this regard, the surface for forming the water spray hole rows 10*a*, 10*b* thereon is not limited to a bent surface but may also be a conical surface. The water spray hole rows does not necessarily be of double arrangement but may also be of single or of triple arrangement.

While the minimum diameter of the water spray holes is not particularly limited as long as they can be processes, it is desirably not less than 0.1 mm and more preferably not less than 0.2 mm in view of plate thickness and workability of photo-etching.

The water spray plate of the present invention may be utilized for shower heads used in shower rooms, bathrooms, wash sinks or in barbershops and beauty salons.

What is claimed is:

1. A water spray plate having on a surface thereof at least 130 water spray holes, each having a diameter of 0.1 mm to 0.5 mm, and an entire aperture area of the water spray holes being not more than 30 $mm^2$, wherein the water spray holes are made by performing photo-etching in a metallic thin plate.

2. The water spray plate according to claim 1, wherein a plurality of first water spray holes are made in a central portion in a concentrated manner and a plurality of second water spray holes from annular rows, around the first water spray holes.

3. The water spray plate according to claim 2, wherein the second water spray holes forming the annular rows form a plurality of concentric annular rows of water spray hole rows.

4. The water spray plate according to claim 2, wherein the second water spray holes forming annular rows have a greater diameter than the first water spray holes made in a central portion in a concentrated manner.

5. The water spray plate according to claim 2, wherein a part of the surface on which the second water spray holes are located, is curved inwardly such that water output from the second water spray hole rows expands outwardly.

6. A shower head having a main body connected to a shower hose at one end and to a water spray plate at the other end, wherein the water spray plate has on a surface thereof at least 130 water spray holes, each having a diameter of 0.1 mm to 0.5 mm, an entire aperture area of the water spray holes being not more than 30 $mm^2$, and the water spray holes being made by performing photo-etching in a metallic thin plate.

7. The shower head according to claim 6, wherein a spraying speed of spraying water discharged from the water spray holes is at least 20 km/h when an amount of conducted water is 10 liters/minute.

8. The shower head according to claim 6, wherein a plurality of first water spray holes are made in a central portion in a concentrated manner and a plurality of second water spray holes form annular rows, around the first water spray holes.

9. The shower head according to claim 8, wherein the second water spray holes forming the annular rows form a plurality of concentric annular rows of water spray hole rows.

10. The shower head according to claim 8, wherein the second water spray holes forming annular rows have a greater diameter than the first water spray holes made in a central portion in a concentrated manner.

11. The shower head according to claim 8, wherein a part of the surface on which the second water spray holes are located, is curved inwardly such that water output from the second water spray hole rows expands outwardly.

* * * * *